US009498096B1

(12) United States Patent
Lo

(10) Patent No.: US 9,498,096 B1
(45) Date of Patent: Nov. 22, 2016

(54) WATER-PRESERVING URINAL

(71) Applicant: Steven Lo, Diamond Bar, CA (US)

(72) Inventor: Steven Lo, Diamond Bar, CA (US)

( * ) Notice: Subject to any disclaimer, the term of this patent is extended or adjusted under 35 U.S.C. 154(b) by 0 days.

(21) Appl. No.: 14/823,654

(22) Filed: Aug. 11, 2015

(51) Int. Cl.
*A47K 11/00* (2006.01)
*A47K 11/12* (2006.01)

(52) U.S. Cl.
CPC ..... *A47K 11/12* (2013.01); *A47K 11/00* (2013.01)

(58) Field of Classification Search
CPC ..... A61G 9/006
USPC ..... 4/144.1–144.4
See application file for complete search history.

(56) References Cited

U.S. PATENT DOCUMENTS 2,815,511 A * 12/1957 Friedman ..... A61G 9/006 4/144.1
2,875,451 A * 3/1959 Stegeman ..... A61G 9/006 4/144.1
4,244,061 A * 1/1981 Webster ..... E03D 13/00 137/247
5,711,037 A * 1/1998 Reichardt ..... E03C 1/281 4/144.1
6,589,440 B2 * 7/2003 Atwill ..... A47K 11/12 137/247.11
6,701,541 B2 * 3/2004 Romagna ..... E03C 1/28 137/247.35
7,636,957 B2 * 12/2009 Funari ..... E03C 1/281 4/144.1
7,921,479 B2 * 4/2011 Hunter ..... C11D 3/48 4/222
8,006,324 B2 * 8/2011 Ophardt ..... E03D 9/00 4/222
8,291,522 B2 * 10/2012 Kueng ..... E03D 13/007 4/144.1
8,739,320 B1 * 6/2014 McTaggart ..... E03C 1/281 4/144.1
9,222,247 B2 * 12/2015 Muderlak ..... E03D 13/007
2004/0163171 A1 * 8/2004 Hall ..... E03C 1/126 4/679
2004/0181861 A1 * 9/2004 Inglin ..... E03C 1/28 4/144.1
2008/0028504 A1 * 2/2008 Higgins ..... E03C 1/281 4/144.1
2008/0295233 A1 * 12/2008 Fima ..... E03D 5/105 4/144.1

* cited by examiner

*Primary Examiner* — Lori Baker
(74) *Attorney, Agent, or Firm* — Che-Yang Chen; Law Offices of Scott Warmuth

(57) ABSTRACT

A water-preserving urinal may include a cylinder body, a cylinder wall, an inner metal ring, an outer metal ring, a central plugin, and a separation cover. The cylinder body is a cylindrical structure, central of which has a drain hole which connects to a drain duct. A periphery of the cylinder body has four inward grooves evenly distributed thereon, and inside of cylinder body has four small notches which are evenly distributed. A support notch is disposed inside the cylinder body to support the cylinder body. The cylinder body is used to receive urine, and the urine can be drained out of cylinder body from the drain hole through the drain tube when the cylinder body is overflowed. The cylinder body is capacious and the notches of the cylinder body are made by biodegradable ABS materials, which can be cleaned easily by dry clothes or paper tissues.

9 Claims, 7 Drawing Sheets

WATER-PRESERVING URINAL

FIELD OF THE INVENTION

The present invention is related to a urinal, and more particularly to a water-preserving urinal that is easy to maintain and clean.

BACKGROUND OF THE INVENTION

More than one in every six people in the world is water stressed, meaning that they do not have access to potable water, and an increasing global population has negatively affected the amount and quality of water. With increasing awareness on water conservation, there is continuous interest in toilets and urinals designed to minimize the amount of water being consumed in flushing to mitigate excessive demands on water supplies as well as on wastewater disposal systems.

U.S. Pat. No. 5,711,037 to Reichardt discloses a waterless urinal, which includes an odor trap cartridge unit configured as a coaxial dual chamber bell trap that eliminates the need for conventional P or J type traps required in water-flushing urinals. In the odor trap, a body of oily liquid sealant, floating on a body of trapped residual urine, serves as an odor barrier but allows urine to enter and immediately permeate downwardly through the sealant and proceed to a drain without flushing. The odor trap is molded from two plastic parts that are assembled together to form a cartridge unit that fits readily into a receptacle cavity of urinal bowl configured for wall mounting. The cartridge stays in place by friction and gravity, and can be easily removed with a special tool. However, the odor trap disclosed by Reichardt is difficult to be removed from the urinal for cleaning purposes. Furthermore, the lifespan for the odor cartridge is short so the user may have to replace it frequently, which is not cost effective.

U.S. Pat. No. 7,636,957 to Funari discloses an oil-based odor trap arrangement for a waterless urinal including (a) a bell trap tube received within a cavity situated in a lower portion of the waterless urinal, wherein one end of the tube is adapted to be removably attached to the cavity and (b) a strainer having a body and defining a cap portion and an integrally attached ring portion extending axially away from the cap portion, wherein the strainer is adapted to be received onto an opposite end of the tube whereby the ring portion partially envelopes the tube thus forming a baffle configured to: 1) contain an oil-based substance between the ring portion and a wall of the cavity; 2) accommodate the flow of fluid from the urinal between the ring portion and the tube; and 3) direct the fluid into the tube. However, the oil-based odor trap system is complicated and it may need trained personnel to clean and maintain such a system, which may incur extra costs to the users. Therefore, there remains a need for a new and improved water-preserving urinal that is easy to maintain and clean to overcome the problems stated above.

SUMMARY OF THE INVENTION

To solve the problems stated above, the present invention provides a water-preserving urinal, which comprises a cylinder body, a cylinder wall, an inner metal ring, an outer metal ring, a central plugin, and a separation cover. The cylinder body is a cylindrical structure, central of which has a drain hole which connects to a drain duct. A periphery of the cylinder body has four inward grooves evenly distributed thereon, and inside of cylinder body has four small notches which are evenly distributed. A support notch is disposed inside the cylinder body to support the cylinder body. The cylinder body is used to receive urine, and the urine can be drained out of cylinder body from the drain hole through the drain tube when the cylinder body is overflowed.

In one embodiment, the structure of the cylinder wall matches the shape of the cylinder body. A top portion of the cylinder wall has a protruding shoulder and a periphery of the cylinder wall has four wall grooves, which are evenly distributed, to connect to four inward grooves of the periphery of the cylinder body. The periphery of the protruding shoulder also has four smaller grooves which are evenly distributed.

In another embodiment, a first gasket is disposed between the cylinder body and the cylinder wall to prevent leaking. The inner metal ring, having an inner thread segment, is disposed in the cylinder wall and a protruding ring is disposed at a central portion of the cylinder wall. The outer metal ring, which comprises an outer thread segment, connects to the inner thread segment of the inner metal ring and is disposed on top of the cylinder wall.

A metallic pad, which comprises four screw holes, is disposed on top of the cylinder wall. The outer metal ring is secured when screws are inserted into the screw holes. The central plugin is a horn-shaped structure, an upper portion of which has a guiding plate while the lower portion of which has a hollow tube. The top of the hollow tube, which has an outer thread segment, connects to a lid of central plugin. The upper portion of the hollow tube has a urine drain hole and a plurality of urine entries are formed at the junction of the guiding plate and the hollow tube. The lower portion of the hollow tube has a groove for a second gasket. More specifically, the hollow tube is plugged into the drain hole, which is in the central portion of the cylinder body, and the second gasket is disposed between the hollow tube and the drain hole to prevent leaking.

In a further embodiment, the separation cover is a can-shaped structure, periphery of which has an annular protruding shoulder. The separation cover is configured to cover the central plugin, and more specifically it is disposed outside of the urine drain hole of the hollow tube of the central plugin to reduce urine odor.

Comparing with conventional water preserving urinal, the present invention is advantageous because the cylinder body is capacious and with a unique structure. The notches of the cylinder body are made by biodegradable ABS (Acrylonitrile butadiene styrene) materials, which can be recycled and can be cleaned easily by dry clothes or paper tissues. When the urinary residues appear on the bottom of the urinal, it can be cleaned by spraying cleaning reagents or water on the inner wall and the shell of the urinal. Namely, the urinal in the present invention does not need a flushing system to clean itself, so a huge amount of water can be saved.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
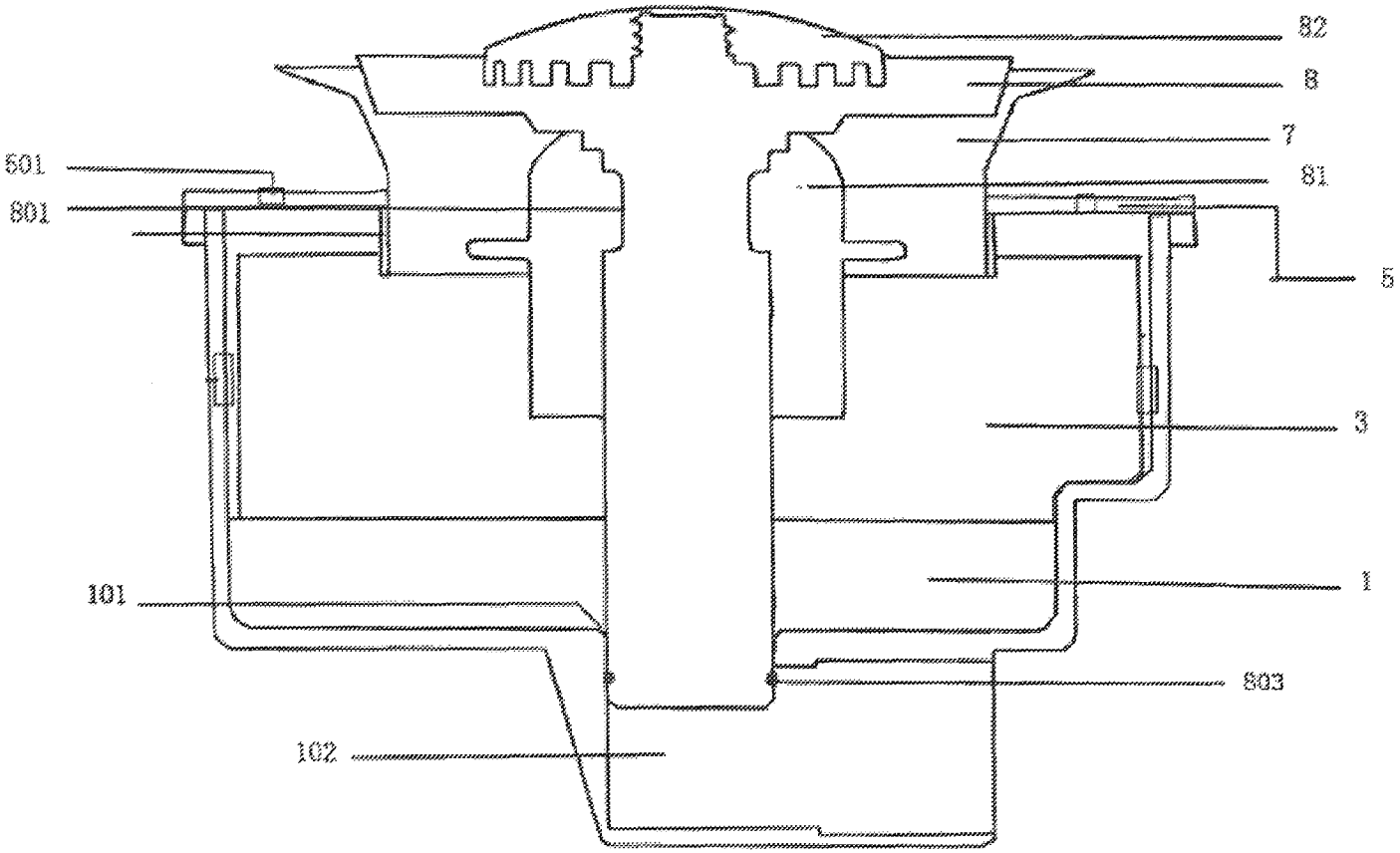
FIG. 1 illustrates a sectional view of the urinal in the present invention.
Figure 2:
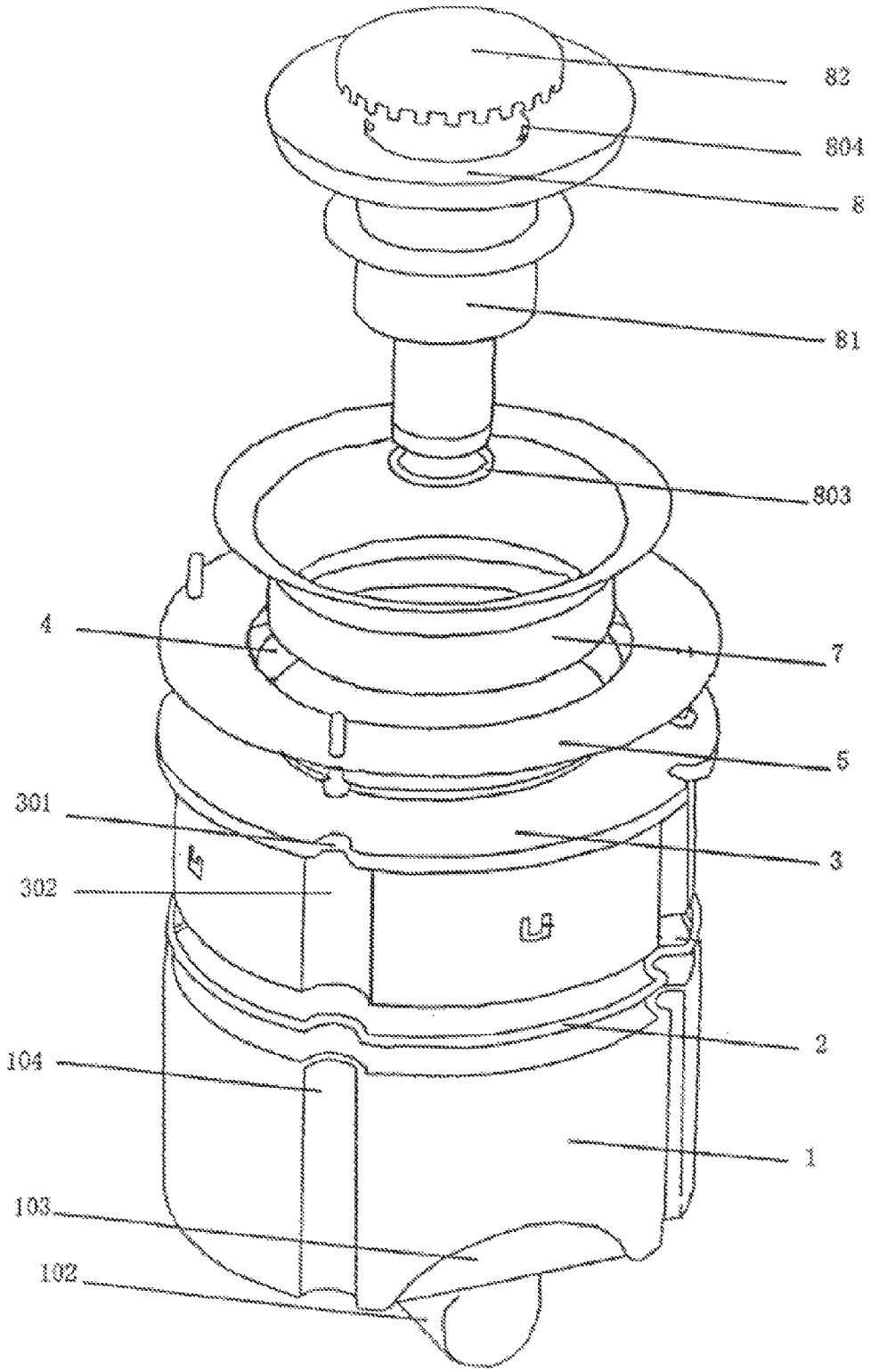
FIG. 2 illustrates an exploded view of the urinal in the present invention.
Figure 3:
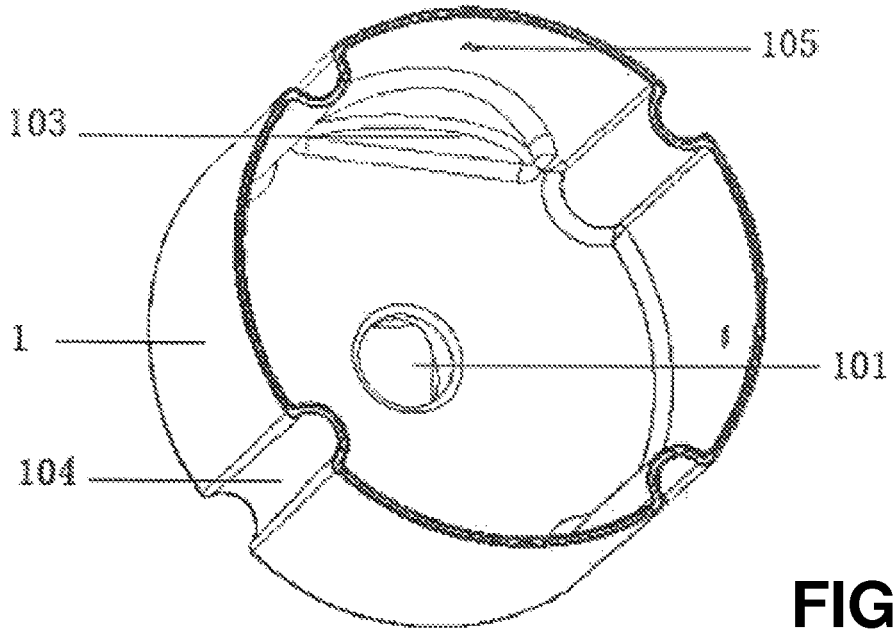
FIG. 3 illustrates a three-dimensional view of the urinal in the present invention.
Figure 3A:
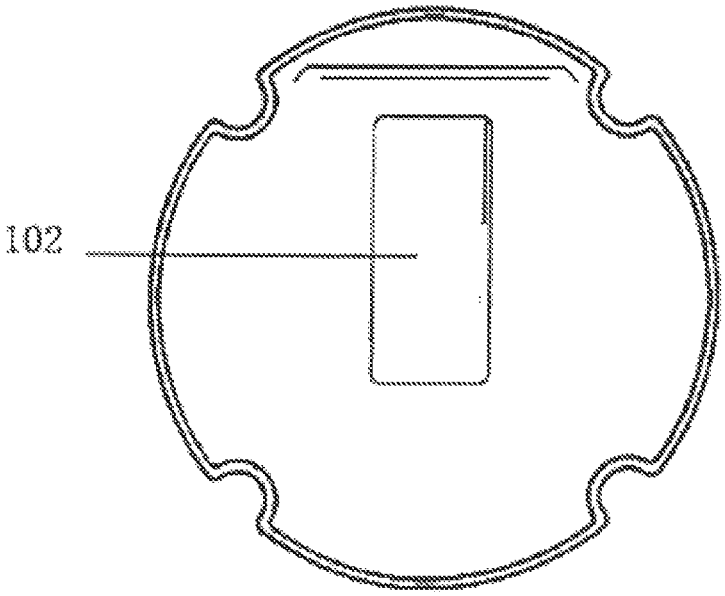
FIG. 3A illustrates a rear view of FIG. 3 in the present invention.
Figure 4:
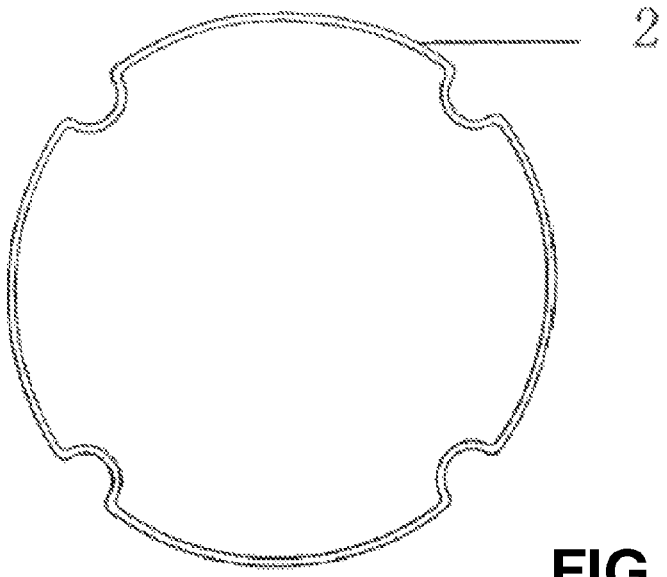
FIG. 4 is a schematic view of the gasket in the present invention.
Figure 5:
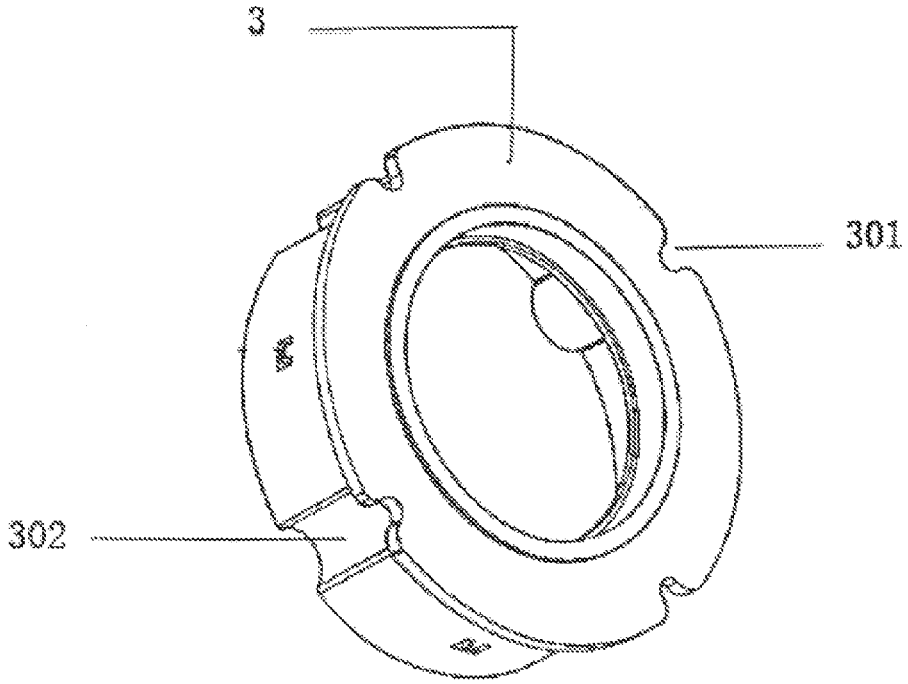
FIG. 5 illustrates a schematic view of the cylinder wall in the present invention.
Figure 6:
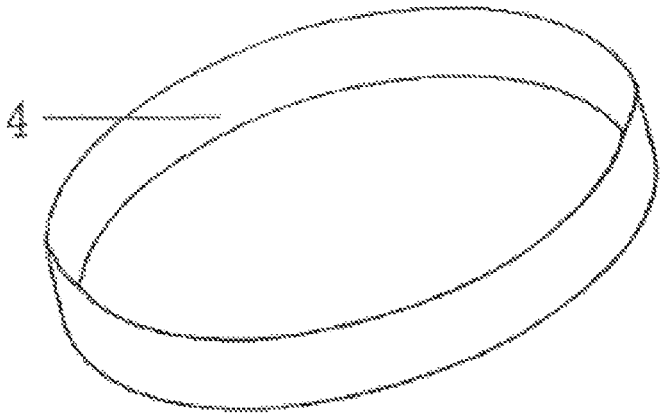
FIG. 6 is a schematic view of the inner metal ring in the present invention.
Figure 7:
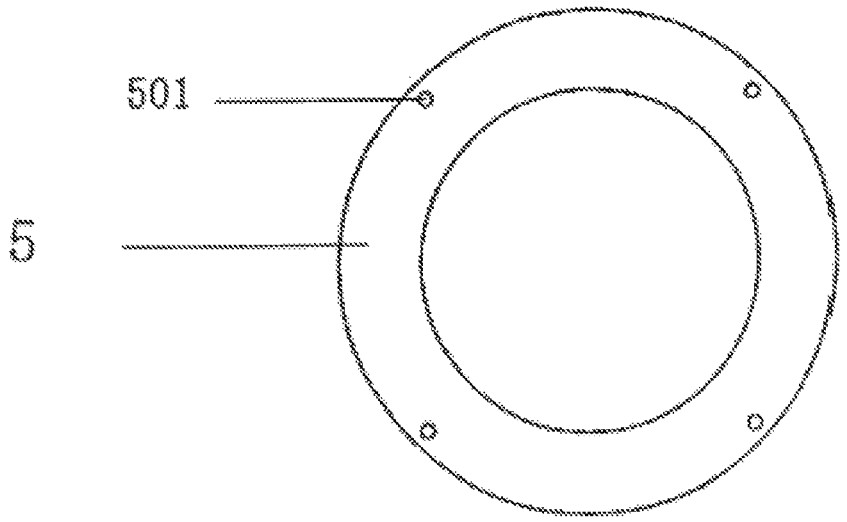
FIG. 7 is a schematic view of the metallic pad in the present invention.
Figure 8:
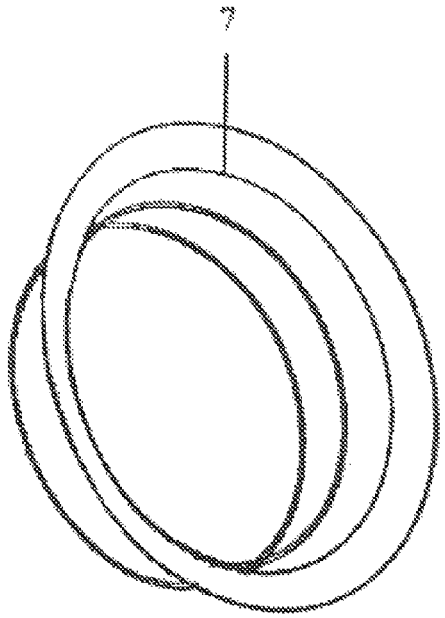
FIG. 8 is a schematic view of the outer metal ring in the present invention.
Figure 9:
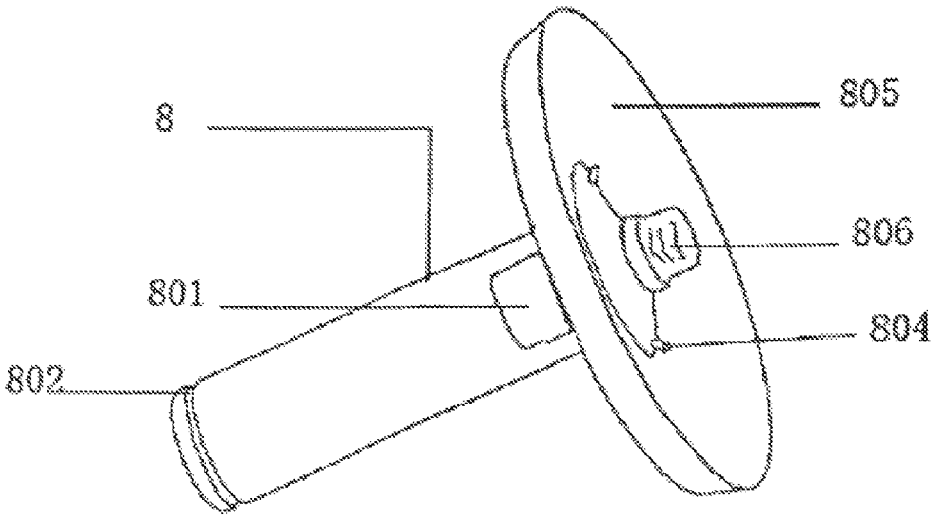
FIG. 9 is a schematic view of the central plugin in the present invention.
Figure 10:
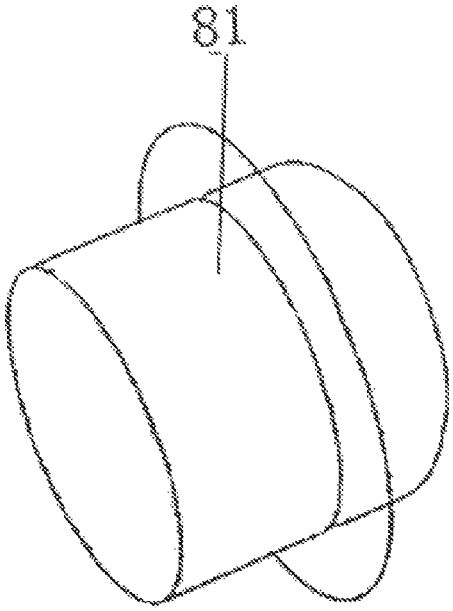
FIG. 10 is a schematic view of the separation cover in the present invention.
Figure 11:
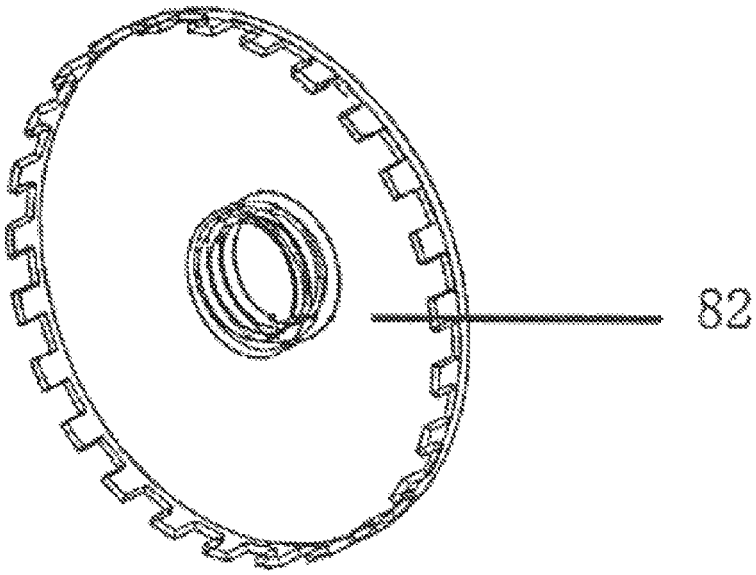
FIG. 11 is a rear schematic view of the lid of the central plugin in the present invention.

In order to further understand the goal, characteristics and effect of the present invention, a number of embodiments along with the drawings are illustrated as following:

Referring to FIGS. 1 to 11, the present invention provides a water-preserving urinal, which comprises a cylinder body (1), a cylinder wall (3), an inner metal ring (4), an outer metal ring (7), a central plugin (8), and a separation cover (81). The cylinder body (1) is a cylindrical structure, central of which has a drain hole (101) which connects to a drain duct (102). A periphery of the cylinder body (1) has four inward grooves (104) evenly distributed thereon, and inside of cylinder body (1) has four small notches (105) which are distributed evenly. A support notch (103) is disposed inside the cylinder body (1) to support the cylinder body (1). The cylinder body (1) is used to receive urine, and the urine can be drained out of cylinder body (1) from the drain hole (101) to the drain tube (102) when the cylinder body (1) is overflowed. It is noted that the support notch (103) and small notches (105) are made by biodegradable ABS (Acrylonitrile butadiene styrene) materials, which can be recycled and can be cleaned easily by dry clothes or paper tissues.

The structure of the cylinder wall (3) matches the shape of the cylinder body (1). A top portion of the cylinder wall (3) has a protruding shoulder and a periphery of the cylinder wall (3) has four wall grooves (302), which are distributed evenly, to connect to four inward grooves (104) of the periphery of the cylinder body (1). The periphery of the protruding shoulder also has four smaller grooves (301) which are distributed evenly to connect with the small grooves of the cylinder body (1).

In one embodiment, a first gasket (2) is disposed between the cylinder body (1) and the cylinder wall (3) to prevent leaking. The inner metal ring (4), having an inner thread segment, is disposed in the cylinder wall (3) and a protruding ring is disposed at a central portion of the cylinder wall (3). The outer metal ring (7), which comprises an outer thread segment, connects to the inner thread segment of the inner metal ring (4) and is disposed on top of the cylinder wall (3).

A metallic pad (5), which comprises four screw holes (501), is disposed on top of the cylinder wall (3). The outer metal ring (7) is secured when screws are inserted into the screw holes (501). The central plugin (8) (see FIG. 9) is a horn-shaped structure, an upper portion of which has a guiding plate (805) while the lower portion of which has a hollow tube (802). The top of the hollow tube (802), which has an outer thread segment (806), connects to a lid (82) of central plugin (8). The upper portion of the hollow tube (802) has a urine drain hole (801) and a plurality of urine entries (804) are formed at the junction of the guiding plate (805) and the hollow tube (802). The lower portion of hollow tube (802) the central plugin (8) has a groove for a second gasket (803). More specifically, the hollow tube (802) is plugged into the drain hole (101), which is in the central portion of the cylinder body, and the second gasket (803) is disposed between the hollow tube (802) and the drain hole (101) to prevent leaking.

The separation cover (81) is a can-shaped structure, periphery of which has an annular protruding shoulder. The separation cover (81) is configured to cover the central plugin (8), and more specifically it is disposed outside of the urine drain hole (801) of the hollow tube (802) of the central plugin (8) to reduce urine odor.

The shape of the lid (82) of central plugin (8) is like a round cap, a periphery of which is serrated to prevent outside objects from entering into the cylinder body (1) to cause obstruction. A rear portion of the lid (82) of central plugin (8) has a connecting column, which comprises an inner thread segment, connects to the outer thread segment on the top of the hollow tube (802) of the central plugin (8).

Comparing with conventional water preserving urinal, the present invention is advantageous because the cylinder body (1) is capacious and with a unique structure. The notches (104, 105) of the cylinder body (1) are made by biodegradable ABS materials, which can be recycled and can be cleaned easily by dry clothes or paper tissues. When the urinary residues appear on the bottom of the urinal, it can be cleaned by spraying cleaning reagents or water on the inner wall and the shell of the urinal. Namely, the urinal in the present invention does not need a flushing system to clean itself, so a huge amount of water can be preserved.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A water-preserving urinal comprising:

a cylinder body comprising:

a drain hole at a center portion thereof and connecting to a drain duct;

a plurality of inward grooves evenly distributed at a periphery of the cylinder body;

a plurality of small notches which are distributed evenly inside the cylinder body; and a support notch disposed inside the cylinder body to support the cylinder body, a cylinder wall disposed above the cylinder body and a first gasket disposed therebwteeen;

an inner metal ring having an inner thread segment and disposed in the cylinder wall;

an metal ring having an outer thread segment, connecting to the inner thread segment of the inner metal ring, and disposed on top of the cylinder wall; and a central plugin plugging into the drain hole of the cylinder body and having a separation cover and a lid.

2. The water-preserving urinal of claim 1, wherein the cylinder body is used to receive urine, which is drained out of cylinder body from the drain hole through the drain tube when the cylinder body is overflowed.

3. The water-preserving urinal of claim 1, wherein the support notch and small notches are made by biodegradable ABS materials.

4. The water-preserving urinal of claim 1, wherein a top portion of the cylinder wall has a protruding shoulder and a periphery of the cylinder wall has a plurality of wall grooves, which are distributed evenly, to connect to four inward grooves of the periphery of the cylinder body, and a periphery of the protruding shoulder has four smaller grooves which are distributed evenly to connect with the small grooves of the cylinder body.

5. The water-preserving urinal of claim 1, further comprising a metallic pad having a plurality of screw holes and disposed on top of the cylinder wall, and the outer metal ring being secured when screws are inserted into the screw holes.

6. The water-preserving urinal of claim 1, wherein the central plugin is a horn-shaped structure, an upper portion of which has a guiding plate while the lower portion of which has a hollow tube, and an upper portion of the hollow tube having an outer thread segment is connected to a lid of central plugin.

7. The water-preserving urinal of claim 6, wherein the upper portion of the hollow tube has a urine drain hole and a plurality of urine entries are formed at the junction of the guiding plate and the hollow tube, and a lower portion of hollow tube the central plugin has a groove for a second gasket.

8. The water-preserving urinal of claim 1, wherein the separation cover is a can-shaped structure, periphery of which has an annular protruding shoulder, and the separation cover is configured to be disposed outside of the urine drain hole of the hollow tube of the central plugin to reduce urine odor.

9. The water-preserving urinal of claim 1, wherein a periphery of the lid is serrated to prevent outside objects from entering into the cylinder body to cause obstruction.

* * * * *